US005417285A

United States Patent [19]

Van Buskirk et al.

[11] Patent Number: 5,417,285

[45] Date of Patent: May 23, 1995

[54] METHOD AND APPARATUS FOR SEALING AND TRANSFERRING FORCE IN A WELLBORE

[75] Inventors: Richard G. Van Buskirk; Michael J. Loughlin, both of Houston, Tex.

[73] Assignee: Baker Hughes Incorporated, Houston, Tex.

[21] Appl. No.: 258,130

[22] Filed: Jun. 10, 1994

Related U.S. Application Data

[63] Continuation of Ser. No. 926,872, Aug. 7, 1992, abandoned.

[51] Int. Cl.[6] ..... E21B 33/12

[52] U.S. Cl. ..... 166/292; 166/192; 166/281

[58] Field of Search ..... 166/285, 292, 192, 281, 166/278

[56] References Cited

U.S. PATENT DOCUMENTS

| | | | |
|---|---|---|---|
| 1,627,991 | 5/1927 | Owen . | |
| 1,979,802 | 11/1934 | Kinley | 166/192 X |
| 2,229,325 | 1/1941 | Greene | 166/13 |
| 2,465,564 | 3/1949 | Abrams | 166/285 X |
| 3,064,734 | 11/1962 | Toelke | 166/63 |
| 3,231,021 | 1/1966 | Green, Jr. | 166/117 |
| 3,233,673 | 2/1966 | Spain et al. | 166/281 X |
| 3,262,499 | 7/1966 | Fleming | 166/278 |
| 3,460,625 | 8/1969 | Hart et al. | 166/285 |
| 3,664,421 | 5/1972 | Urbanosky | 166/278 |
| 3,866,681 | 2/1975 | Shirley | 166/285 |
| 4,419,989 | 4/1980 | Colangelo | 428/65 |
| 4,491,178 | 1/1985 | Terrell et al. | 166/192 |
| 4,621,692 | 11/1986 | Mendshine | 166/281 |
| 4,913,233 | 4/1990 | Fitzgibbon, Jr. | 166/285 |
| 5,095,983 | 3/1992 | Magnani | 166/250 |

FOREIGN PATENT DOCUMENTS

| | | | |
|---|---|---|---|
| 1113829 | 4/1956 | France . | |
| 2079348 | 1/1982 | United Kingdom | E21B 33/06 |

OTHER PUBLICATIONS

Steven D. Moore, "Thru-Tubing Inflatables Find Workover Niche", Jul. 1991, Petroleum Engineer International, No. 7.

*Primary Examiner*—William P. Neuder
*Attorney, Agent, or Firm*—Melvin A. Hunn

[57] ABSTRACT

A wellbore is at least partially obstructed with a partition or obstruction member. A fluid slurry of an aggregate mixture of particulate matter is pumped into the wellbore adjacent the partition or obstruction member. The aggregate mixture of particulate material contains at least one component of particulate material, and each of the at least one particulate material components has an average discrete particle dimension different from that of the other particulate material components. Fluid pressure then is applied to the aggregate material and fluid is drained from the aggregate material through a fluid drainage passage in the partition or obstruction member. The fluid pressure and drainage of fluid from the aggregate mixture combined to compact the aggregate mixture into a substantially solid, load-bearing, force-transferring, substantially fluid-impermeable plug member, which seals a first wellbore region from fluid flow communication with a second wellbore region. The plug member is easily removed from the wellbore by directing a high-pressure fluid stream toward the plug member, thereby dissolving or disintegrating the particulate material of the plug member into a fluid slurry, which may be circulated out of or suctioned from the wellbore.

99 Claims, 12 Drawing Sheets

| TEST | MIXTURE A - B - C - D | MILLIDARCIES |
|---|---|---|
| 1 | 00 - 00 - 00 - 00 | 2000.000 |
| 2 | 60 - 20 - 20 - 00 | 66.000 |
| 3 | 80 - 10 - 10 - 00 | 415.000 |
| 4 | 60 - 30 - 10 - 00 | 233.000 |
| 5 | 60 - 10 - 30 - 00 | 51.000 |
| 6 | 40 - 30 - 30 - 00 | 50.000 |
| 7 | 60 - 20 - 15 - 05 | 0.064 |
| 8 | 60 - 15 - 15 - 10 | 0.063 |
| 9 | 60 - 20 - 15 - 05 | 0.081 |

A = 20/40 MESH SAND
B = 100 MESH SAND
C = 200 MESH SAND
D = BENTONITE "GEL" (CLAY)

FIGURE 5

METHOD AND APPARATUS FOR SEALING AND TRANSFERRING FORCE IN A WELLBORE

This is continuation of application Ser. No. 07/926,872, filed Aug. 7, 1992, now abandoned.

BACKGROUND OF THE INVENTION

1. Field of the Invention

The present invention relates generally to methods and apparatuses for forming downhole pressure plugs in a wellbore. More particularly, the present invention relates to methods of forming downhole plugs to seal the wellbore and to transfer stress from a wellbore tool to the wellbore itself.

2. Description of the Prior Art

It is conventional in the oil and gas industry to seal wellbores using packers, bridge plugs, and the like. Typically, a wellbore tool, such as a packer or bridge plug, is run into the wellbore to a desired location therein. The packer or bridge plug is inflated or otherwise actuated into sealing engagement with the wellbore. Such a seal may be effected to separate regions in the wellbore, to contain fluid pressure either above or below the wellbore tool for fracturing or other well treatment operations, or other conventional reasons.

Conventional wellbore tools have a force threshold beyond which the wellbore tool will fail mechanically, or will lose gripping and sealing engagement with the wellbore, which tends to cause undesirable movement of the wellbore tool within the wellbore. The force threshold typically is defined in terms of a maximum or limiting differential pressure across the wellbore tool that the wellbore tool can withstand without failure or movement in the wellbore.

If the force threshold is exceeded, mechanical failure of the wellbore tool or undesirable movement of the wellbore tool may result. Mechanical failure may result in at least partial inoperability of the wellbore tool. If the wellbore tool is rendered inoperable, the wellbore may be undesirably obstructed, requiring expensive fishing remedial operations. Mechanical failure at least will require expensive and time-consuming repair or replacement of the wellbore tool.

Even if the wellbore tool does not fail and is not otherwise damaged, the wellbore tool may be moved or displaced within the wellbore if the force threshold is exceeded. Such movement or displacement is undesirable because the positioning of the wellbore tool within the wellbore frequently is of great importance. Also, movement or displacement of the wellbore tool could damage other wellbore tools or the producing formation itself, thereby necessitating fishing, workover, or other remedial wellbore operations.

In secondary recovery operations, such as formation fracturing, reliable and dependable packers and bridge plugs frequently are necessary. Many secondary recovery operations require sealing off or packing a selected formation interval, and introducing extremely high pressure fluids into the selected interval. High-pressure fluids exert extreme axial forces on the packers or bridge plugs used to seal off the interval. Thus, the possibility of exceeding the force threshold of such wellbore tools is very great in formation fracturing, and requires the use of expensive, reinforced, high-pressure rated wellbore tools. High-pressure wellbore tools typically have relatively large cross-sectional diameters, precluding their use in through-tubing operations or operations in otherwise reduced-diameter or obstructed wellbores.

An alternative to high-pressure rated wellbore tools is to plug or seal the wellbore with cement. Cement plugs have a number of drawbacks. Expensive and specialized cementing equipment usually is required to pump cement into the wellbore to form a cement plug. Also, a significant time period must elapse to permit a cement plug to harden or set into a sealing or load-bearing cement plug. Another drawback of cement plugs is that they are relatively permanent, and require expensive and time-consuming milling operations to remove them from the wellbore.

SUMMARY OF THE INVENTION

It is one objective of the present invention to provide an apparatus for sealing a wellbore, wherein a first wellbore region is isolated from fluid communication with a second wellbore region.

It is another objective of the present invention to provide a method and apparatus for forming a sealing plug member within a wellbore, wherein the plug member transfers force resulting from pressurized fluid in the wellbore to the wellbore itself, obviating the need for high-pressure rated wellbore sealing tools.

It is yet another objective of the present invention to provide a method and apparatus for sealing a wellbore with a plug member that is both strong and substantially fluid-impermeable, yet is easily and quickly removable from the wellbore using conventional wellbore tools.

These and other objectives of the present invention are accomplished by at least partially obstructing a wellbore with a partition or obstruction member. A fluid slurry of an aggregate mixture of particulate matter is pumped into the wellbore adjacent the partition or obstruction member. The aggregate mixture of particulate material contains at least one component of particulate material, and each of the at least one particulate material components has an average discrete particle dimension different from that of the other particulate material components. Fluid pressure then is applied to the aggregate material and fluid is drained from the aggregate material through a fluid drainage passage in the partition or obstruction member. The fluid pressure and drainage of fluid from the aggregate mixture combined to compact the aggregate mixture into a substantially solid, load-bearing, force-transferring, substantially fluid-impermeable plug member, which seals a first wellbore region from fluid flow communication with a second wellbore region. The plug member is easily removed from the wellbore by directing a high-pressure fluid stream toward the plug member, thereby dissolving or disintegrating the particulate material of the plug member into a fluid slurry, which may be circulated out of or suctioned from the wellbore.

Preferably, the aggregate mixture of particulate matter contains a binder component comprising a finely dispersed particulate material which is capable of hydrating and swelling to fill pores or interstitial spaces between other particulate material components of the aggregate mixture of the plug member.

Other objects features and advantages of the present invention will become apparent to those skilled in the art with reference to the drawings and detailed description, which follow.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 5 is a table illustrating the results of permeability tests performed on various mixtures and aggregate mixtures for use in forming a plug member according to the present invention;

DETAILED DESCRIPTION OF THE INVENTION

Figure 1:
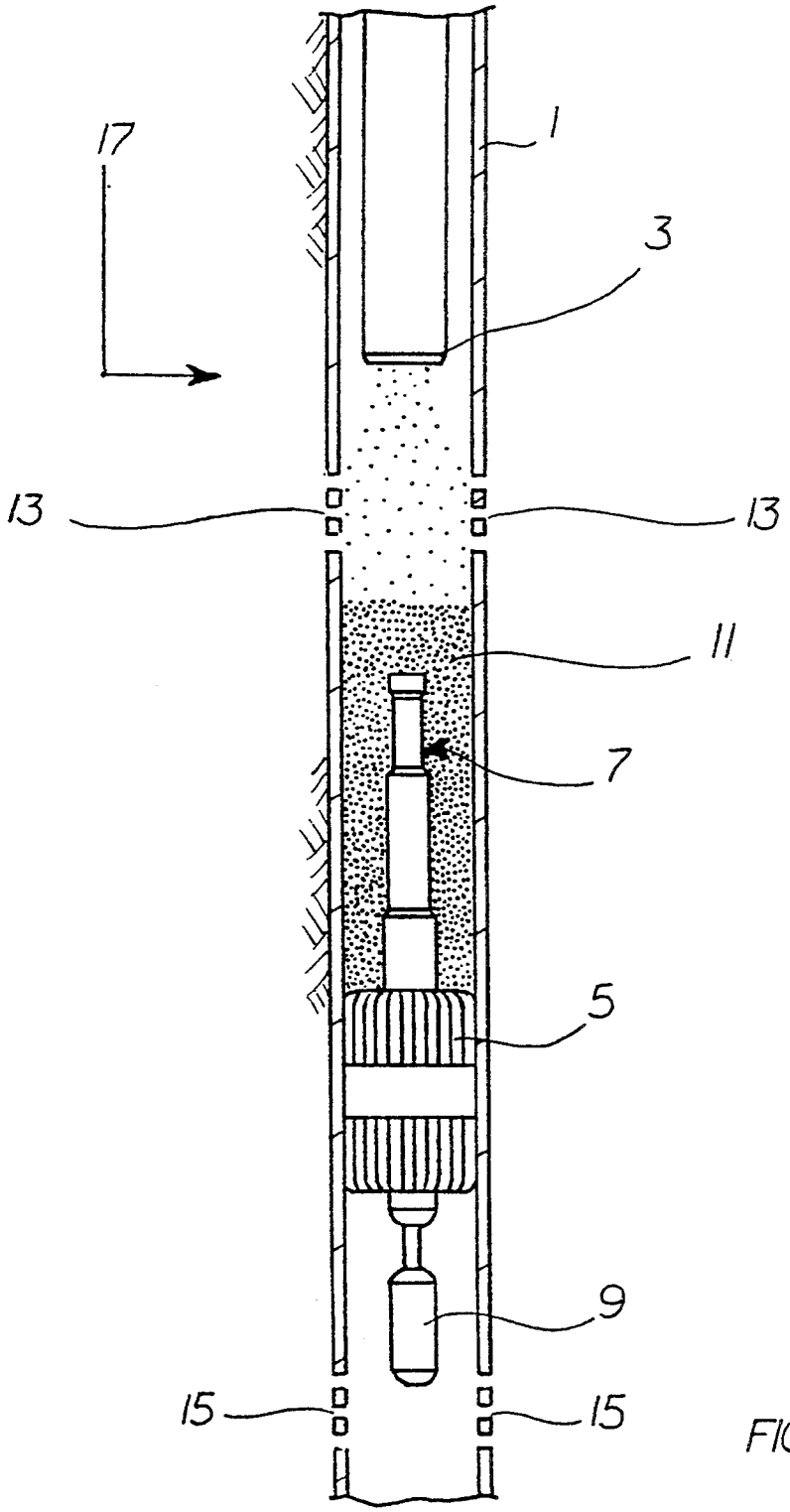
FIG. 1 illustrates, in partial longitudinal section, a wellbore including the apparatus according to the present invention.

Referring now to the figures, and specifically to FIG. 1, a preferred embodiment of the wellbore apparatus according to the present invention will be described. FIG. 1 illustrates, in partial longitudinal section, a wellbore 1. Wellbore 1 is shown as a cased wellbore, but the present invention is contemplated for use in open wellbores, production tubing, or the like, having conduit or a fluid passageway therethrough in which a pressure-tight seal may be advantageous. Wellbore 1 is provided with a source of axial force, in this case a workstring 3. In the case of workstring 3, the source of axial force is fluid pressure, but may be any other source of axial force. A removable partition or obstruction member 5 is disposed in wellbore 1. In this case, partition or obstruction member is an inflatable packer 5. However, the obstruction or partition member may be any sort of wellbore tool that is capable of selectively, and at least partially obstructing fluid flow from a first region of wellbore 1 from a second region. Inflatable packer 5 is provided at an upper extent with a screen filter assembly 7, and at a lower end with fluid outlet 9. The utility and function of screen filter 7 and fluid outlet 9 will be described hereinafter.

A pressure plug or plug member 11 according to the present invention is disposed adjacent to and above inflatable packer 5. Plug member 11 comprises a compacted aggregate mixture of particulate matter. Plug member 11 provides a substantially fluid-impermeable seal in wellbore 1, and thereby isolates a first region of wellbore 1 from fluid flow communication with a second region. Further, plug member 11 serves to transfer axial force from the source of axial force (in this case, fluid pressure from workstring 3) laterally to wellbore 1, thereby permitting use of a lower-pressure rated inflatable packer 5 or other obstruction or partition member.

The specific wellbore operation illustrated in FIG. 1 is a secondary recovery operation, such as formation fracturing. Thus, wellbore 1 is provided with two sets of perforations 13, 15. Each set of perforations 13, 15 and the area defines a region in wellbore 1. In secondary recovery operations, it may be advantageous to isolate one set of perforations, in this case upper set 13, from another set of perforations, in this case lower set 15, so that secondary recovery operations can be directed to only one formation through a single set of perforations 13. The secondary recovery operation illustrated in FIG. 1 is known conventionally as fracturing the formation. In such a fracturing operation, wellbore 1 is packed-off, preferably with a plug member 7 according to the present invention. Workstring 3 then is run into wellbore 1, and fracturing fluid 17, which is conventional, is pumped into wellbore 1, out through perforations 13, and into the formation. Frequently, tremendous pressures are required to force fracturing fluid 17 into the formation. These fluid pressures may be exerted on wellbore 1, plug member 11, and inflatable packer 5. Such a fracturing operation, if employing only an inflatable packer 5 or other wellbore tool, would require inflatable packer 5 to withstand extreme differential pressure, and the resulting axial force, without mechanical failure or movement within wellbore 1. Accordingly, such high-pressure rated inflatable packers 5, as well as other high-pressure rated wellbore tools, are very expensive. Additionally, such wellbore tools generally are larger in diameter, which may preclude their use in through-tubing workover operations.

Plug member 7 is advantageous in that it provides a substantially fluid-impermeable seal in wellbore 1, and transfers axial force (caused in this case by fluid pressure from workstring 3) laterally to the wellbore and away from inflatable packer 5. Therefore, low-pressure rated inflatable packers 5, or other low-pressure rated wellbore tools, can be used in conjunction with plug member 11 according to the present invention and still maintain a substantially fluid-impermeable and strong seal in wellbore 1.

Figure 2:
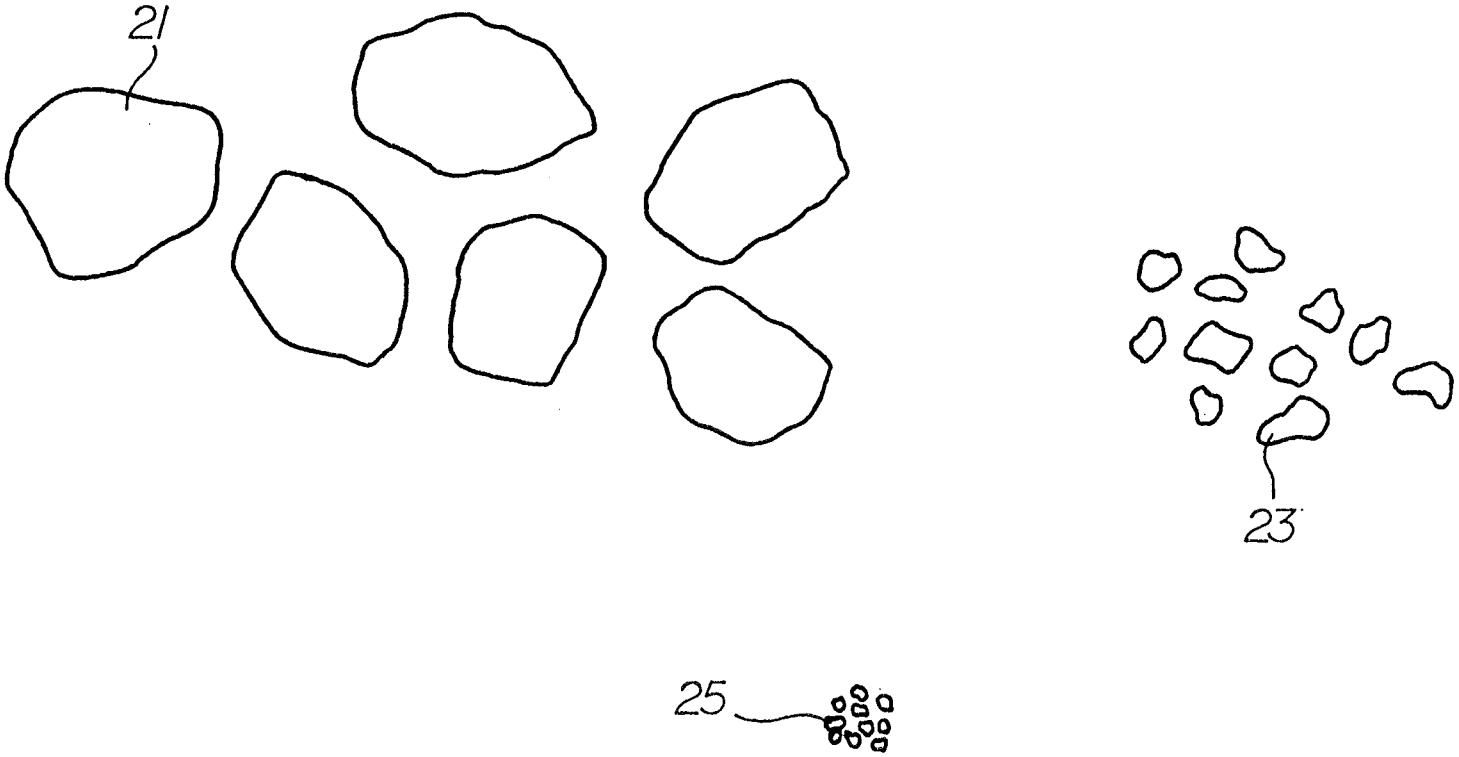
FIG. 2 schematically illustrates relative sizes of the particulate matter that makes up the aggregate mixture, which forms a plug member according to the present invention.

FIG. 2 schematically illustrates the relative sizes of the classes of particulate matter that makes up the aggregate mixture that forms plug member 11 according to the present invention. Preferably, the particulate matter is silica sand, or silicon dioxide. Sand particles 21 schematically represent grains of conventional, coarse 20/40 mesh, sand. The term "mesh" is conventional in the industry and represents an average discrete particle size for particulate materials, particularly sand. Recommended Practice Number 58, entitled "Recommend Practices for Testing Sand Used in Gravel Packing Operations," published by the American Petroleum Institute, Dallas, Tex., is exemplary of the measurement of average discrete particle size of sands. Intermediate sand grains 23 schematically illustrate the size of 100 mesh silica sand, as contrasted to the size of coarse 20/40 mesh silica sand. Fine sand particles 25 schematically illustrate the relative size of 200 mesh sand particles, as contrasted to intermediate 100 mesh sand particles 23 and coarse 20/40 mesh sand particles 21. According to the present invention, an aggregate mixture of silica sand particles of various dimensional classes or mesh sizes is employed to form plug member 11. The use of sand particles 21, 23, 25 of varying average discrete particle dimension is important to forming the substantially fluid-impermeable, force transferring plug member 11 according to the present invention.

Figure 3:
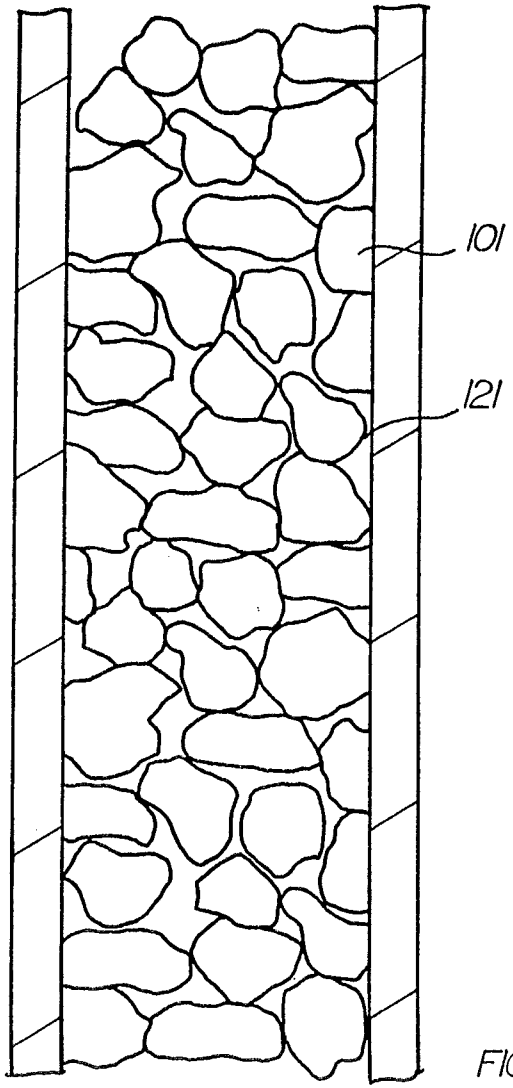
FIG. 3 schematically depicts a wellbore containing coarse sand particles.

FIG. 3 schematically depicts a wellbore 101 containing coarse sand particles 121. Coarse sand particles 121 are schematically depicted as particles of 20/40 mesh silica sand, as illustrated in FIG. 2. As is illustrated, there are numerous pores and interstitial spaces between individual sand particles 121. These pores or interstitial spaces permit the sand to be fluid-permeable, and also provide room for individual sand particles 121 to displace relative to each other in response to forces applied to the sand.

Figure 4:
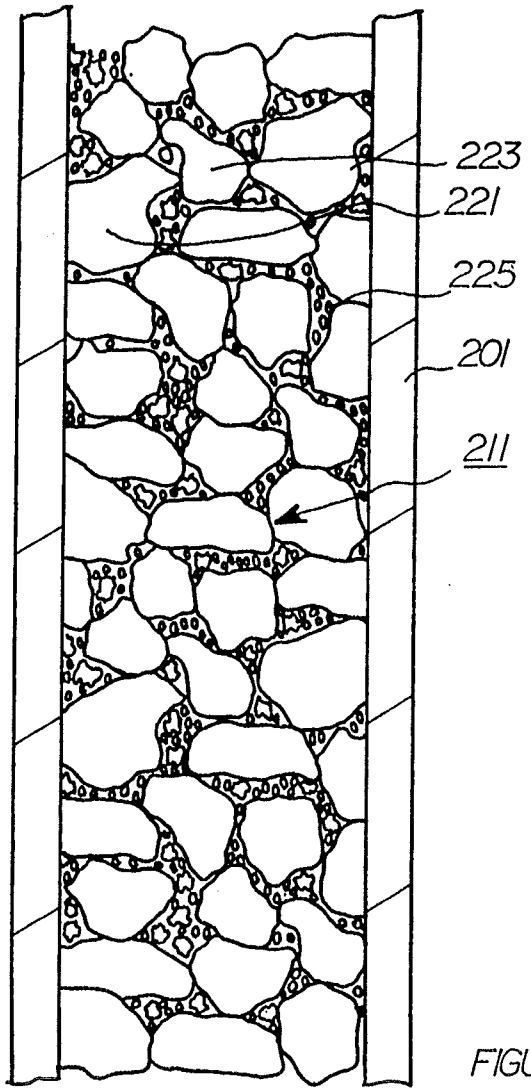
FIG. 4 illustrates a wellbore containing an aggregate mixture in accordance with the present invention.

FIG. 4 illustrates a wellbore 201 containing a plug member 211 in accordance with the present invention. Plug member 211 comprises an aggregate mixture of coarse, 20/40 mesh sand particles 221, intermediate, 100 mesh sand particles 223, and fine, 200 mesh sand particles 225. As is illustrated, the aggregate mixture of coarse, intermediate, and fine sand particles cooperate to reduce the volume of pores and interstitial spaces between the various sand particles 221,223, 225. Such an aggregate mixture results in a more substantially fluid-impermeable plug member 211, and provides less space for individual sand grains to displace and move in response to forces exerted on plug member 211.

FIG. 5 is a table illustrating the results of permeability tests performed on various mixtures and aggregate mixtures for use in forming plug member 11,211 according to the present invention. In the left hand column is a number assigned to each test performed. The central column indicates the volumetric percentage of each component making up the aggregate mixture, wherein component A is 20/40 mesh silica sand (illustrated as 21 in FIG. 2, 121 in FIG. 3, and 221 in FIG. 4), component B is 100 mesh silica sand (illustrated as 223 in FIG. 4), component C is 200 mesh silica sand (illustrated as 225 in FIG. 4), and component D is a bentonite or clay "gel." the right hand column indicates the measured or estimated fluid permeability of the mixture or aggregate mixture tested, in millidarcies. The Darcy is a unit of fluid permeability of materials, which is determined according to Darcy's law, which follows:

$$K = \frac{Q\mu L}{PA}$$

wherein,

P=pressure across sand (in bars);

$\mu$=dynamic viscosity of fluid (in centipoise);

A=cross-sectional area of sand (in square centimeters);

L=length of sand column (in centimeters);

Q=volume flow rate of effluent from sand column (in milliliters per second); and K=permeability (in centimeters per second).

Accordingly, each aggregate sand mixture tested was formed into a column of known length L, and known cross-sectional area A. A fluid having a known dynamic viscosity $\mu$, in this case water, was placed at one end of the sand column at a known pressure P. At an opposite end of the column, the flow rate of fluid effluent through the column Q was measured. The foregoing known and measured data was inserted into the above-identified mathematical statement of Darcy's law, and a permeability K was obtained in millidarcies. For test number one, a sand column of 100% 20/40 mesh sand was tested, and yielded an estimated permeability of 2,800 millidarcies. As a second test, an aggregate mixture containing 60% by volume 20/40 mesh sand, 20% by weight 100 mesh sand, and 20% by weight 200 mesh sand was tested, and yielded a permeability of 66 millidarcies. As a third test, an aggregate mixture of 80% by weight 20/40 mesh sand, 10% by weight, 100 mesh sand, and 10% by weight 200 mesh sand was tested and yielded a permeability of 415 millidarcies. As a fourth test, an aggregate mixture of 60% by weight 20/40 mesh sand, 30% by weight 100 mesh sand, and 10% by weight 200 mesh sand was tested and yielded a permeability of 233 millidarcies. As a fifth test, an aggregate mixture of 60% by weight 20/40 mesh sand, 10% by weight 100 mesh sand, and 30% by weight 200 mesh sand was tested and yielded a permeability of 51 millidarcies. As a sixth test, an aggregate mixture of 40% by weight 20/40 mesh sand, 30% by weight 100 mesh sand, and 30% by weight 200 mesh sand was tested and yielded a permeability of 50 millidarcies.

Test numbers 7, 8 and 9 reflect aggregate mixtures that are preferred for use in forming plug member 11, 211 according to the present invention. The aggregate mixtures tested in tests 7, 8 and 9 contain a fourth or binder component, five to ten percent by weight of bentonite. Bentonite is a rock deposit that contains quantities of a desirable clay mineral called montmorillonite. Montmorillonite is a colloidal material that disperses in fluid or water into individual, flat, plate-like clay crystals with dimensions ranging between about five and five hundred millimicrons. The flat plate-like clay crystals presumably overlap each other very tightly to produce a generally substantially fluid-impermeable structure. Additionally, montmorillonite crystals "hydrate" in water, wherein water molecules bond to the crystals, causing the crystals to swell to enlarged dimensions, which may further obstruct pores or interstitial spaces between coarser particles. Bentonite or bentonitic clays are interchangeable terms for any clay-like material possessing the properties discussed herein.

The addition of a binder of bentonite or bentonitic clay material to the aggregate mixtures described herein results in an aggregate mixture having an extremely low fluid permeability. It is believed that the microscopic nature of the clay particles, combined with their ability to hydrate and swell, permits the clay particles to fill and almost completely obstruct any pores or interstitial spaces remaining in an aggregate sand mixture (as illustrated in FIG. 4). This theory is borne out by the test results in tests 7, 8, and 9. For test 7, an aggregate mixture of 60% by weight 20/40 mesh sand, 20% by weight 100 mesh sand, 15% by weight 200 mesh sand, and 5% by weight of bentonite material was tested and yielded a permeability of 0.064 millidarcies. For test number 8, an aggregate mixture of 60% by weight 20/40 mesh sand, 15% by weight 100 mesh sand, 10% by weight 200 mesh sand, and 15% by weight of bentonite material was tested, and yielded permeability of 0.063 millidarcies. For a ninth and final test, an aggregate mixture of 60% by weight 20/40 mesh sand, 20% by weight 100 mesh sand, 15% by weight 200 mesh sand, and 5% by weight bentonite material was tested and yielded a permeability of 0.081 millidarcies.

From the foregoing test results, trends indicating preferred compositions of aggregate mixtures for use in forming plug member 11, 211 according to the present invention can be noted. Marked decreases in fluid permeability are obtained by adding significant quantities of fine sand particles, such as 200 mesh sand, to a mixture containing coarse sand and intermediate sand components. A further reduction in permeability is obtained by adding ultra-fine, hydrating particles, such as bentonite or bentonitic clay materials.

Figure 6:
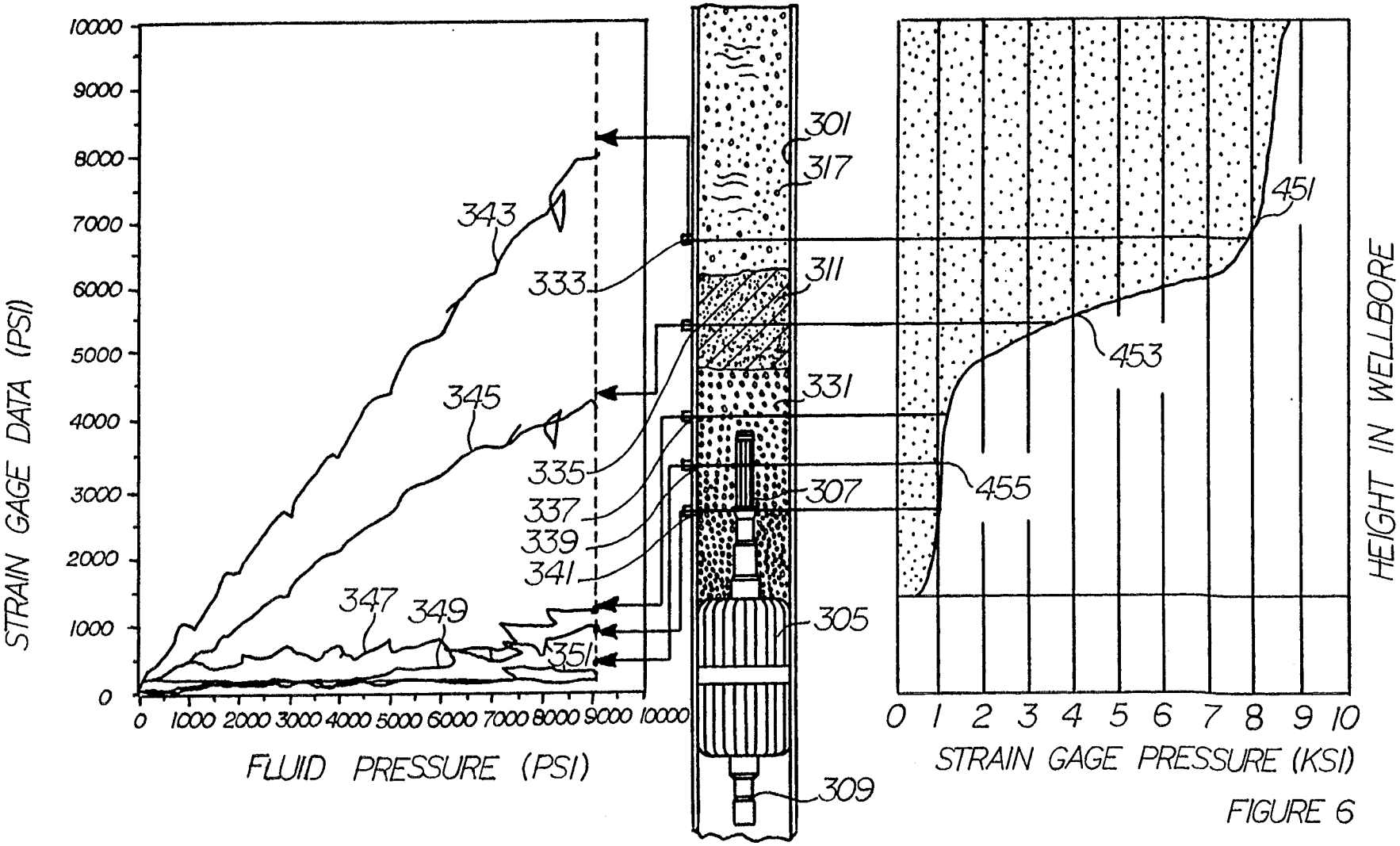
FIG. 6 depicts a superimposition of a pair of graphs of data obtained during testing of a pressure plug or plug member according to the present invention.

FIG. 6 depicts a superimposition of a pair of graphs of data obtained during testing of a pressure plug or plug member 311 according to the present invention. As illustrated in the central portion of FIG. 6, the test rig comprises an artificial wellbore, in this case a length of casing 301, with a partition member, in this case an inflatable packer 305, disposed within wellbore 301. Inflatable packer 305 is further provided with a screen filter 307 at an uppermost end thereof, which is in fluid communication with a fluid exhaust member 309 at a lowermost extent of inflatable packer 305.

Adjacent and atop inflatable packer 305 is column of drainage sand 331 approximately 3 feet in height. Drainage sand 307 is a coarse, preferably 20/40 mesh, silica sand. Because the relatively coarse drainage sand 331 has a significant quantity of pores and interstitial spaces between individual sand particles, 307 will function as a pre-filter for fluid entering screen filter 307 of inflatable packer 305. Such a pre-filter is advantageous to prevent extremely fine particles from entering inflatable packer 305 and tending to cause abrasion and resulting failure of inflatable packer 305.

It is believed to be important to provide either a column of drainage sand, or to maximize the content (consistent with the desired level of fluid-impermeability) of relatively coarse (20/40 mesh silica sand) particles in the aggregate mixture so that drainage of plug members 11, 211, 311 is enhanced and to facilitate removal of plug member 11, 211, 311, by washout. Without coarse particles, plug member 11, 211, 311 may compact into a rock-like member that cannot be removed easily.

A pressure plug or plug member 311 according to the present invention is formed atop drainage sand 331. According to the preferred embodiment of the present invention, plug member 311 is a column of aggregate mixture as described herein that is twelve inches in height. The preferred aggregate mixture is that described with reference to test number 7 (60% by weight 20/40 mesh silica sand, 20% by weight 100 mesh silica sand, 15% by weight 200 mesh silica sand, and 5% by weight bentonite), having a measured fluid permeability of 0.064 millidarcies.

A quantity of pressurized fluid, in this case water 317, is disposed in wellbore above plug member 311. Pressurized fluid 317 serves as the source of axial force in the illustrated preferred embodiment. Pressurized fluid 317 exerts hydrostatic pressure both in a radial and an axial direction within wellbore 301. Because wellbore 301 typically is extremely strong, and resistant to deformation, the axial force component, which otherwise would act directly on inflatable packer 305, is the quantity of interest for purposes of the present invention.

Wellbore 301 is provided with a number of strain gauges 333, 335, 337, 339, 341, which measure normalized hoop stress in wellbore 301, thereby giving an indication of force transferred through plug member 311 to wellbore 301.

During the test illustrated in FIG. 6, pressurized fluid 317 was stepped-up in pressure in 1,000 pounds per square inch (psi) increments ranging from 0 psi to 9,000 psi. The resulting strain gauge outputs, 343, 345, 347, 349, 351, and implicit force measurements, are plotted over the range of pressure increases in the left hand portion of FIG. 6. The abscissa axis of the left hand graph plots the magnitude of fluid pressure in pressurized fluid 317 in wellbore 301. The ordinate axis of the left hand graph plots hoop stress values measured by stain gauges 333, 335, 337, 339, 341. As is illustrated, strain gauge 333, which is located on an exterior of wellbore 301 at a point in which wellbore 301 is filled with pressurized fluid, shows the largest variation in measured hoop stress 343 as fluid pressure is increased. Strain gauge 335 which is located on the exterior of wellbore 301 where wellbore 301 is obstructed by plug member 311, indicates the second highest change in measured hoop stress 345. Stain gauge 337, which is located on the exterior of wellbore 301 at a point where wellbore 301 is filled with drainage sand 331, but above sand filter 307, measures a hoop stress 347 maximum of approximately 1,000 psi. Strain gauge 339, which is located on the exterior of wellbore 301 at a location where wellbore 301 is filled with drainage sand 331 and sand filter 307, measures a hoop stress 349 maximum of somewhat less than 1,000 psi. Strain gauge 341, which is located on the exterior of wellbore 301 wherein wellbore 301 is filled with drainage sand 331, and is just below screen filter 307 measures a hoop stress 351 maximum of less than 500 psi.

The right hand graph of FIG. 6 depicts the pressure distribution over the length of wellbore 301, from areas filled by pressurized fluid 317 to the top of inflatable packer 305. The abscissa axis of the right hand graph plots measured hoop stress values, and is substantially similar to the ordinate axis of the left hand graph. The ordinate axis of the right hand graph corresponds with the height of wellbore 301 and correlates transfer of force from pressurized fluid 317 through plug member 311 and drainage sand 331, to wellbore 301. As is illustrated, upper right portion 451 of the plotted line is substantially vertical and reflects a relatively uniform pressure distribution in wellbore 301, which is to be expected because at that point, wellbore 301 is filled with pressurized fluid 317, which exerts a generally uniform hydrostatic pressure on wellbore 301. A central portion 453 of the plotted line indicates a significant measured pressure drop in wellbore 301 where wellbore 301 is occupied by plug member 311 according to the present invention. A lower left portion 455 of the plotted line indicates a fairly steady, maintained low pressure, which averages less than 1,000 psi in wellbore 301. The significant pressure drop in wellbore 301 where it is occupied by plug member 311 according to the present invention indicates that the axial force exerted by pressurized fluid 317 substantially is transferred by sand plug 311 to wellbore 301. Thus, a relatively insignificant axial force load of generally less than 1,000 psi is experienced by drainage sand and inflatable packer 305. Because such a large magnitude of axial force resulting from pressurized fluid 317 in wellbore 301 is transferred to the generally stronger wellbore 301, much weaker and less expensive inflatable packers 305, or other wellbore tools may be employed with plug member 311 according to the present invention to seal a first wellbore region against fluid flow to or from a second wellbore region.

Figure 7:
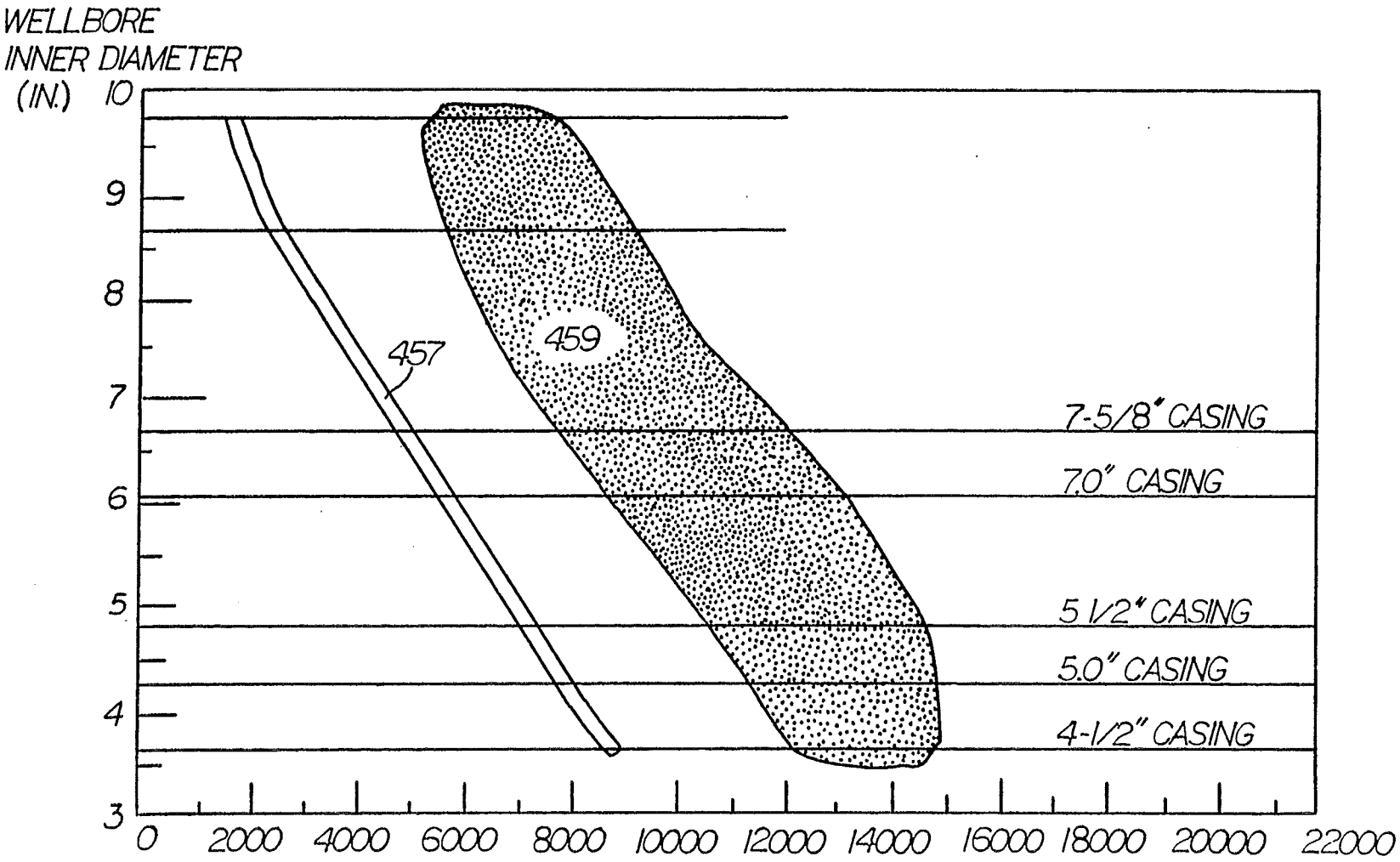
FIG. 7 is a graph comparing the pressure rating of conventional high-pressure rated inflatable packers with the pressure rating of plug member formed according to the present invention.

FIG. 7 is a graph comparing the pressure rating of conventional high-pressure rated inflatable packers (such as 305 in FIG. 6) with the pressure rating of plug member 11, 211, 311 formed according to the present invention. The abscissa axis of the graph plots the values of limiting differential pressure of failure threshold that each type of sealing member can withstand and maintain effective sealing integrity. The ordinate axis plots the casing inner diameter of the wellbore to be sealed. Plotted line 457 represents the pressure rating of a high-pressure rated, 3⅜" outer diameter inflatable packing element. The ability of the packing element to withstand pressure differentials (limiting differential pressure in FIG. 7) is a function of the diameter of the casing or wellbore that the inflatable packer must seal. For small diameter casing, such as 4½" casing, the limiting differential pressure or failure threshold is relatively high at approximately 9,000 psi. However, as the casing or wellbore diameter increases, the inflatable packer must expand further to sealingly engage the casing inner diameter, thus reducing the pressure differential (limiting differential pressure) that it is capable of withstanding. Therefore, for a large diameter casing, such as 10¾" diameter casing, the inflatable packer can only withstand a pressure differential (limiting differential pressure) of approximately 2,000 psi. In contrast, the pressure rating of a plug member 11, 211, 311, according to the present invention is much higher, and is less sensitive to casing diameter than are conventional inflatable packing elements. Area 459 of FIG. 7 represents the pressure rating of plug members 11, 211, 311 formed according to the present invention, as predicted by tests conducted substantially as described with reference to FIG. 6. As is illustrated, in relatively small diameter casing, plug members 11, 211, 311 can withstand pressure differentials (limiting differential pressure) of upwards of 14,000 psi. In larger diameter casing, plug members 11,211, 311 formed according to the present invention can withstand pressure differentials (limiting differential pressure) of upwards of 5,000 psi. From the data depicted in FIG. 7, it becomes apparent that plug members 11, 211, 311 formed according to the present invention possess significant advantages over conventional inflatable packer elements and other wellbore tools.

Figure 8:
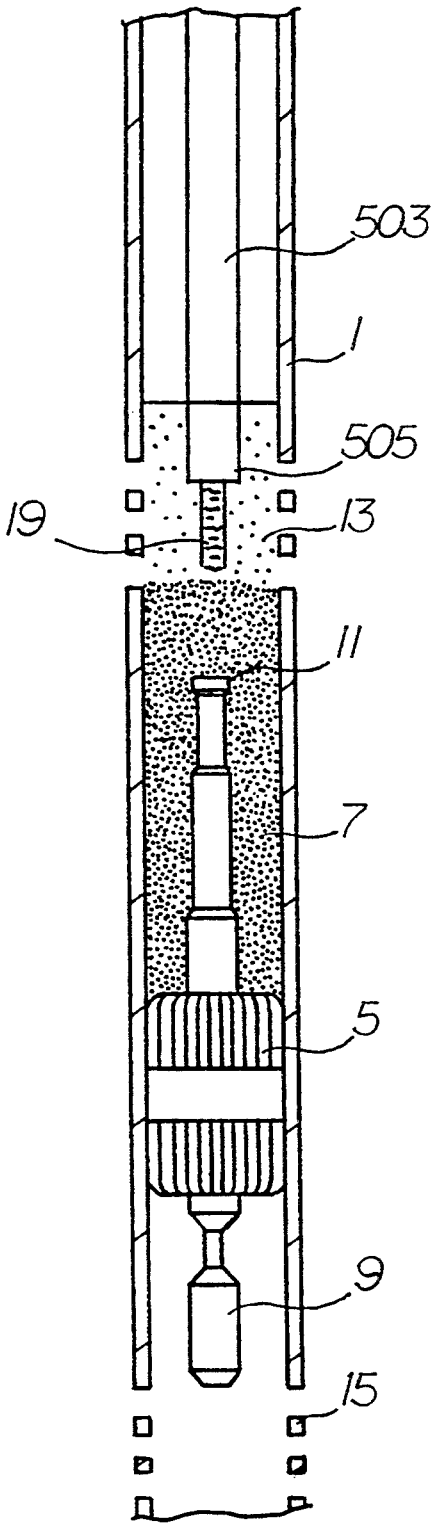
FIG. 8 is a partial longitudinal section view of the sealing and load-bearing apparatus of FIG. 1, the apparatus being shown in a plug member removal or washing-out mode of operation.
Figure 9A:
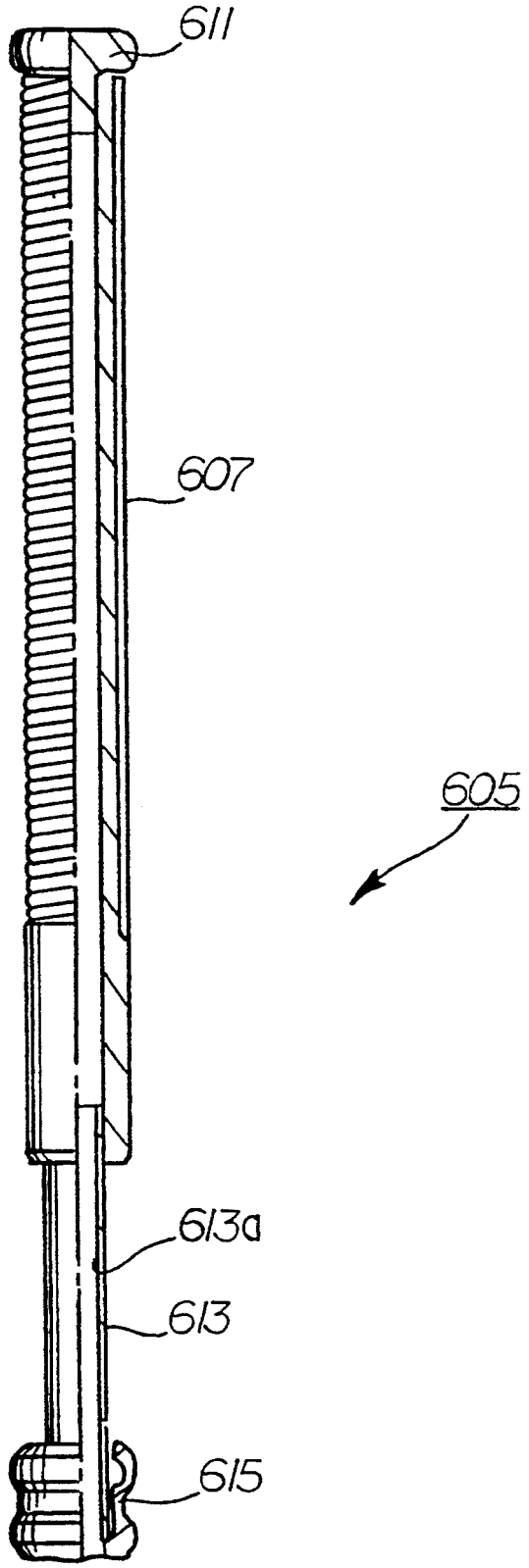
FIGS. 9*a* through 9*e* should be read together and depict a one-quarter longitudinal section view of a partition or obstruction member according to the present invention.
Figure 9B:
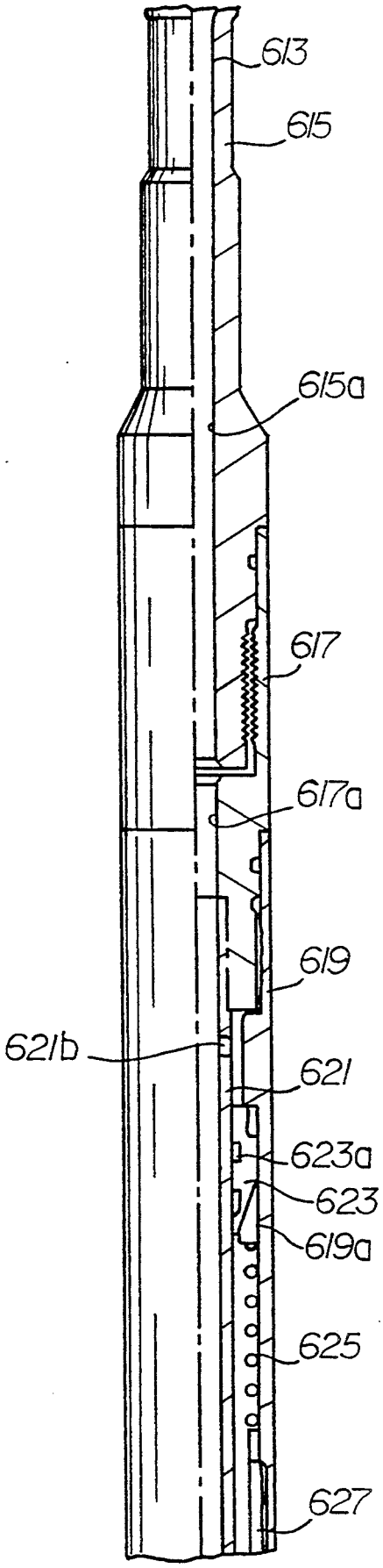
Figure 9C:
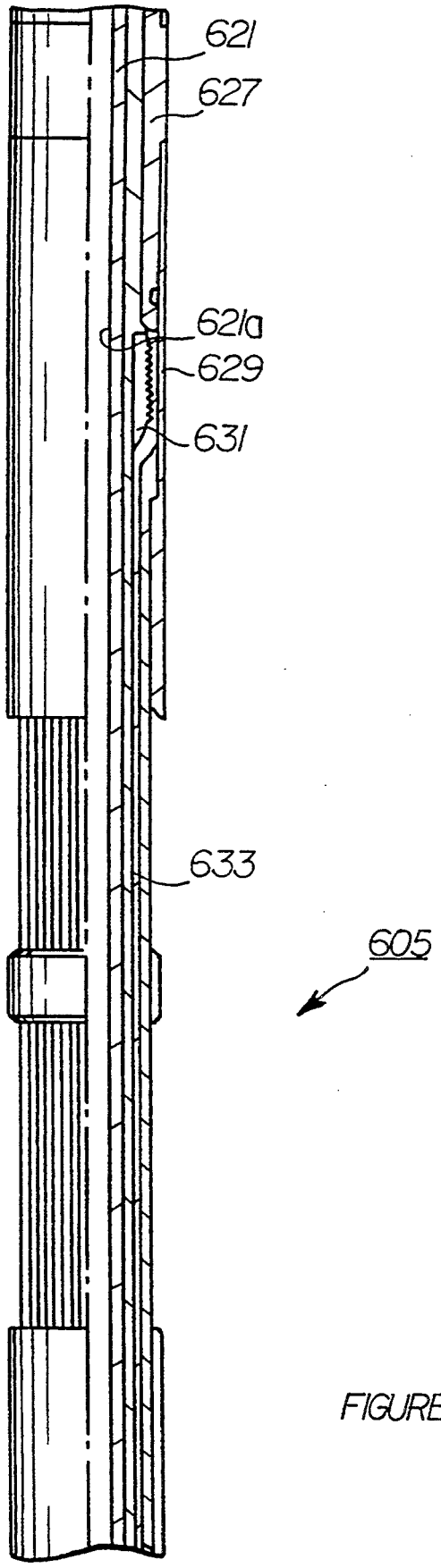
Figure 9D:
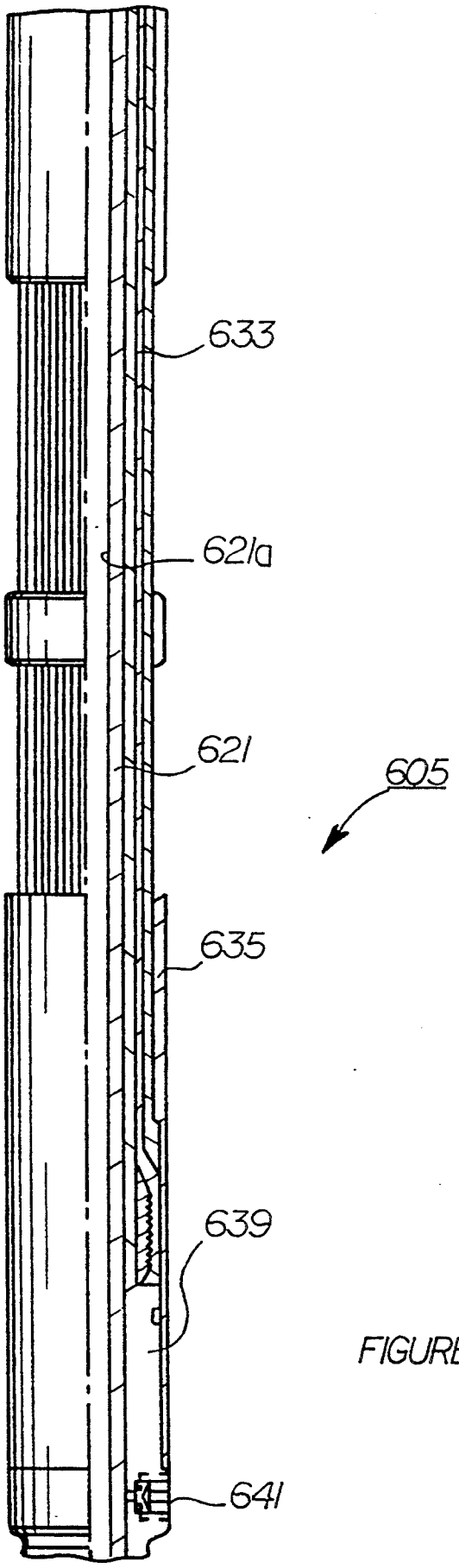
Figure 9E:
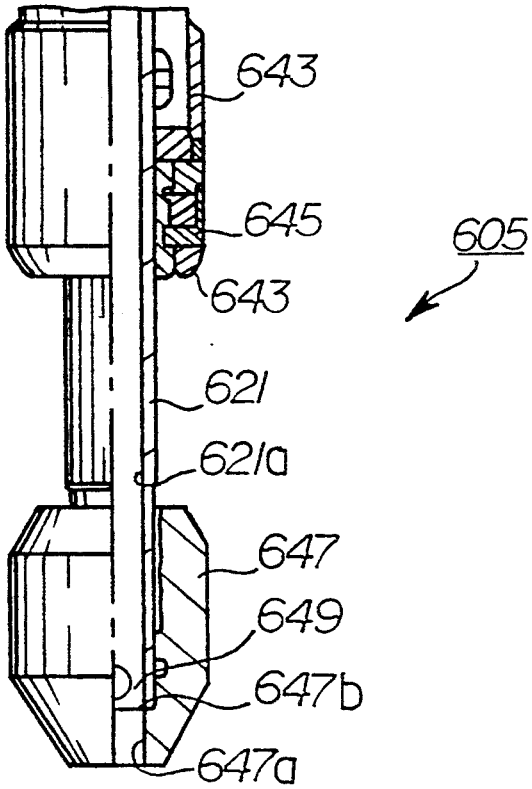

FIG. 8 is a partial longitudinal section view of the sealing and load-bearing apparatus of FIG. 1, the apparatus being shown in a plug member 11 removal or washing-out mode of operation. As in FIG. 1, wellbore 1 has removable partition or obstruction member 5, including screen filter member 7 and fluid exhaust member 9, and plug member 11 disposed therein. Original fracturing workstring 3 is replaced by a circulating or washout workstring 503. Circulating or washout workstring 503 is provided with a nozzle at a terminal end thereof for directing a high-pressure fluid stream 19 toward plug member 11. High pressure fluid stream 19 is provided to dissolve or wash out plug member 11. As is illustrated, the impact of high pressure fluid stream 19 upon plug member 11 causes the particulate matter of plug member 11 to separate into discrete particles. Relatively slow-moving wellbore fluid suspends the particles of particulate matter so that the particulate matter and wellbore fluid 505 may be circulated out of or suctioned from wellbore 1. After plug member 11 is fully disintegrated, inflatable packer member 5 may be conventionally deflated and retrieved. Therefore, plug member 11 according to the present invention, while stronger and capable of bearing more load with excellent sealing integrity, is simply and easily removed from wellbore 1 when its presence is no longer desirable.

FIGS. 9*a* through 9*e*, which should be read together, depict in one-quarter longitudinal section, a partition or obstruction member, in this case an inflatable bridge plug 605, according to the present invention. A screen filter 607 is provided at an uppermost end of bridge plug 605. Screen filter 607 is plugged at its upper end with plug member 611. A connection tube 613 connects a lower extent of screen filter 607 in fluid communication with fishing neck 615. Fishing neck 615 is provided with a fluid flow conduit 615*a* therethrough for fluid communication with upper element adapter 617. Upper element adapter 617 is connected by threads to fishing neck 615, and is provided with a fluid conduit 617*a* therethrough and is connected by threads to poppet housing 619.

A mandrel 621 is connected by threads to upper element adapter 617. Mandrel 621 is provided with a fluid conduit 621*a* therethrough, and also includes a fluid port 621*b*. A poppet 623 is disposed between an exterior of mandrel 621 and an interior of poppet housing 619. Poppet 623 is further provided with a pair of seal members 623*a*. Poppet is biased upwardly by a biasing member or spring 625.

An element adapter 627 is connected by threads to poppet housing 619. Element adapter 627 is connected by threads to an upper element ring 629. Upper element ring 629 cooperates with upper wedge ring 631 to secure a conventional inflatable packer element 633 to element ring 629. Inflatable packer element 633 is conventionally constructed of elastomeric materials and a plurality of circumferentially overlapping flexible metal strips.

A lower element ring 635 is secured to inflatable packing element 633 by lower wedge ring 637. Lower element ring 629 is connected by threads to a lower element adapter 639. Lower element adapter 639 is provided with a threaded bleed port 641, which is selectively opened and closed to bleed air from between mandrel 621 and inflatable packing element 633 during assembly of bridge plug 605. Lower adapter 639 is connected by threads to a lower housing 643. Lower housing 463 is secured to mandrel 621 by means of a shear member 645, which permits relative motion between lower housing 643 and mandrel 621 upon application of a force sufficient to fail shear member 645.

A guide shoe 647 is connected by threads to mandrel 621, and is provided with a fluid conduit 647*a* in fluid communication with fluid conduit 621*a* of mandrel 621. Guide shoe 647 is further provided with a closure member, in this case a ball seat 647*b*, which is adapted to receive a ball 649 to selectively obstruct fluid flow through inflatable bridge plug 605. Preferably, ball seat 647*b* is a pump-through ball seat, which will release ball 649 and permit fluid flow out of bridge plug 605 upon application of fluid pressure of selected magnitude.

In operation, bridge plug 605 according to the present invention is assembled into a workstring (not shown) at the surface of the wellbore (not shown) and is run into the wellbore to a desired location. At the desired location in the wellbore, bridge plug 605 may be set actuated or inflated into sealing engagement with the wellbore by the following procedure.

Pressurized fluid is pumped through workstring and enters bridge plug 605 through screen filter 607. Pressurized fluid flows from screen filter, fluid conduit 613*a* in connection tube 613, through fluid conduit 615*a* in fishing neck 615, through fluid conduit 617*a* of upper adapter 617, and into fluid conduit 621*a* of mandrel 621. Closure member 647*b*, 649, obstructs the fluid conduit in 621 a in mandrel 621 so that fluid pressure may be increased inside mandrel 621. As fluid pressure increases, fluid flows through port 621*b* into a chamber defined between mandrel 621, upper adapter 617*a*, poppet housing 619, and poppet 623. Responsive to fluid pressure, poppet 623 moves relative to mandrel 621 and poppet housing 619 when the fluid pressure differential acting on poppet 623 exceeds the biasing force of biasing member 625. As poppet 623 moves relative to poppet housing 619, poppet 623 moves past a shoulder 619*a* formed in the interior wall of poppet housing 619, wherein pressurized fluid is permitted to flow around poppet 623 and poppet seal member 623*a*. Fluid continues to flow between the exterior of mandrel 621 and inflatable packing element 633 to inflate inflatable packing member 629.

Inflation of inflatable packing element 633 will cause shear member 645 in lower housing 643 to fail, thereby permitting relative movement between mandrel 621 and lower packing element assembly (which includes lower element ring 635, wedge ring 637, lower element adapter 639, and lower housing 643). Inflation of inflatable packer element 633 and relative movement between the lower element assembly and mandrel 621 permits inflatable packing element 633 to extend generally radially outwardly from mandrel 621 and into sealing engagement with a sidewall of the wellbore.

After sealing engagement is obtained, fluid pressure within mandrel 621 may be reduced, which permits biasing member 625 to return poppet 623 to its original position, blocking fluid flow out of the inflation region defined between mandrel 621 and inflatable packing element 631.

Bridge plug 605 described herein is arranged as a permanent bridge plug. Permanent bridge plugs, once set or inflated, cannot be deflated or unset and removed from the wellbore. It is within the scope of the present invention, however, to provide a retrievable bridge plug, which may be selectively inflated and deflated and removed from or repositioned in the wellbore. Such a retrievable bridge plug may be obtained by provision of conventional deflation means to permit selective inflation and deflation of the retrievable bridge plug. Bridge plug 605 according to the present invention provides a drainage passage 621*a*, in fluid communication with drainage sand (331 in FIG. 6) through sand screen 607, and in communication with an exhaust member (guide shoe 649) to provide drainage of fluid from the plug member according to the present invention.

With reference now to FIGS. 1 through 9*e*, the operation of the present invention will be described. The following description is of a through-tubing formation fracturing operation. However, the present invention is not limited in utility to either through-tubing operations or fracturing and other secondary operations.

As a preliminary step, workstring 3 is prepared at the surface with a terminal end or sub adapted for delivering and setting a partition or obstruction member, preferably inflatable packer 5, 605. Partition or obstruction member 5, 605 need not, however, be inflatable packer 5, 605, but could be any sort of wellbore tool adapted to selectively and at least partially obstruct wellbore 1.

Workstring 3 then is run into wellbore 1 to a selected depth or location therein. As illustrated in FIGS. 1 and 8, the selected depth or location in wellbore 1 may be a point between sets of perforations 13, 15, wherein it is advantageous to separate and isolate a first wellbore region or zone proximal to one set of perforations 13 from a second region or zone proximal to a second set of perforations 15. At the selected depth or location in wellbore 1, partition or obstruction member 5, 605 is set and released from workstring 3 in a conventional manner.

For through-tubing operations, it is advantageous that workstring 3 and partition or obstruction member 5, 605 have outer diameters that are as small as possible to facilitate movement of workstring 3 and partition or obstruction member 5, 605 through reduced-diameter production tubing or otherwise obstructed wellbore sections.

According to a preferred embodiment of the present invention, inflatable packer 5, 605 is provided with an elongate screen filter assembly 7, 607, which is in fluid flow communication with a fluid exhaust assembly 9, 647 to provide fluid drainage. Preferably with such an inflatable packer, a slurry of drainage or filter sand is (331 in FIG. 6) deposited adjacent to inflatable packer 5, 605 in a quantity sufficient to fully encase or enclose screen filter member assembly 7, 607. Such a column of drainage sand provides a pre-filter for the screen filter assembly 7,607, preventing abrasive fines from entering inflatable packer 5, 605 and tending to cause premature mechanical failure of inflatable packer 5, 605. A preferred drainage sand column (331 in FIG. 6) is formed of coarse, 20/40 mesh, silica sand that is pumped into wellbore 11 in a fluid slurry with ordinary fresh water as the slurry fluid.

After partition or obstruction member 5, 605 is set and released, at least partially obstructing wellbore 1, aggregate mixture is prepared at the surface into a fluid slurry. Preferably, the aggregate mixture comprises 60% by weight coarse, 20/40 mesh, silica sand, 20% by weight intermediate, 100 mesh, silica sand, 15% by weight fine, 200 mesh, silica sand, and 5% by weight bentonite or bentonitic material. Preferably, fresh water is used as the slurry fluid to hydrate and disperse bentonitic particles into a colloidal form. The slurry should be sufficiently agitated to ensure dispersion of the bentonitic material.

The aggregate mixture slurry then is pumped through workstring 3 and into wellbore 1 adjacent and atop the drainage sand column. After a sufficient volume of aggregate mixture fluids slurry (a quantity sufficient to produce a column at least 12" in height) is pumped into wellbore 1, pumping should cease. A period of time, preferably greater than five to ten minutes, should elapse to permit the aggregate mixture fluid slurry to settle to a relatively quiescent condition.

After the settling period has elapsed, fracturing operations may be commenced. In a typical fracturing operation, conventional fracturing fluid (17 in FIG. 1 and 317 in FIG. 6) is pumped through workstring 3 into wellbore 1 at a volume flow rate sufficient to achieve the necessary fluid pressure for successful fracturing (typically approaching 10,000 psi). As fluid pressure increases, the axial force exerted by fluid pressure on plug member 11, 211, 311 increases. The increased axial force on plug member 11, 211, 311 compacts plug member 11, 211, 311 and causes drainage of gross water from the aggregate mixture fluid slurry, through drainage sand and drain filter assembly 7, 607, wherein the gross water is exhausted through fluid exhaust assembly below inflatable packer 5, 605. Gross water is fluid contained in the pores or interstitial spaces between sand grains in the aggregate mixture. Gross water is to be distinguished from hydrated water, which comprises small quantities of water that is hydrated or bonded to bentonitic particles. It is extremely advantageous to drain gross water from plug member 11,211,311, so that the aggregate mixture can be compacted to a strong, substantially solid and substantially fluid-impermeable plug member 11,211, 311. Hydrated water is desirable because it maintains bentonitic particles in the hydrated or swelled form, which tends to reduce the fluid permeability of plug member 11, 211, 311.

Thus, a preferred plug member 11, 211, 311 according to the present invention will possess two regions of differing permeability: a solid substantially fluid-impermeable, force transferring region; and a relatively fluid-permeable drainage sand region. Screen filter 7, 607 of inflatable packer 5, 605 permits drainage of gross water from plug member 11, 211, 311 yet prevents significant quantities of the aggregate mixture of plug member 11, 211, 311 or drainage sand 331 from being carried away with the gross water.

As fluid pressure is increased, plug member 11, 211, 311 is compressed and compacted and becomes more substantially fluid-impermeable and stronger. It is believed that plug member 11,211,311 according to the present invention employs a "slip-stick" deformation mechanism, which improves the strength and substantial fluid impermeability of plug member 11, 211, 311. It is believed that the combination of coarse, intermediate, and fine sand particles, along with the ultra-fine, hydrated, bentonitic particles, permits plug member 11, 211, 311 to deform continuously as axial forces exerted thereon vary. This continuous deformation, called the slip-stick mechanism, permits plug member 11, 211, 311 to compact into a strong and substantially fluid-impermeable plug that continuously redistributes stresses within itself, thereby avoiding disintegration and failure. During the fracturing operation, the slip-stick mechanism of the aggregate material of plug member 11, 211, 311 permits plug member 11, 211, 311 to seal against fluid pressure loss, and to transfer axial loads, which otherwise would be exerted directly on inflatable packer 5, 605, to wellbore 1, which can more easily bear such extreme loads. Fluid drainage must be provided to permit the aggregate mixture to compact tightly and to achieve the slip-stick deformation mechanism, which cannot be achieved if the content of gross water in the aggregate mixture is excessive.

It should be noted that force transfer away from partition or obstruction member 5, 605 is sufficiently substantial that partition member 5, 605 may be unset or deflated, and plug member 11, 211, 311 will maintain its strength and sealing integrity.

After fracturing operations are complete, plug member 11,211, 311 may be disintegrated, dissolved, or washed out (substantially as described with reference to FIG. 8) by directing a high-pressure fluid stream 19 from workstring 3. The disintegrated fluid member and fluid may be circulated out of wellbore 1 or suctioned therefrom using a conventional wellbore tool.

Thus, the present invention is operable in a plurality of modes of operation, the modes of operation including: a delivery mode of operation in which an aggregate mixture including particulate matter is conveyed into a wellbore in a fluid slurry form to a position adjacent a partition or obstruction member. Another mode of operation is a compaction mode in which axial force from a source of axial force in the wellbore is applied to the aggregate mixture to compact the aggregate mixture and at least partially form a plug member. Yet another mode of operation is a force-transfer mode in which the plug member transfers force from the source of axial force away from the partition member into the wellbore. Still another mode of operation is a wash-out mode in which the plug member is disintegrated by application of a stream of high-pressure fluid. Still another mode of operation is a communication mode in which the plug member is disintegrated and the partition member is removed from the wellbore thereby allowing fluid communication between first and second wellbore regions.

The present invention has a number of advantages. One advantage of the present invention is the provision of a strong, substantially fluid-impermeable means for sealing against fluid flow communication between a first and second regions in a wellbore. Another advantage of the present invention is that the force-transfer characteristics of the plug member obviate the need for expensive high-pressure rated partition or obstruction members, such as inflatable packers or bridge plugs. Therefore, through-tubing operations and operations in otherwise obstructed wellbores are facilitated and rendered less costly. Still another advantage of the present invention is that the plug member is formed easily and is disintegrated easily, permitting rapid and efficient workover or secondary recovery operations.

While the invention has been shown in only one of its forms, it is not thus limited, but is susceptible to various changes and modifications without departing from the spirit thereof.

What is claimed is:

1. A load-bearing and sealing apparatus for use in a wellbore subject to a source of axial force, said wellbore having a wellbore surface defined therein which forms at least a part of a wellbore passageway which allows communication of fluids and objects between a first wellbore region and a second wellbore region, comprising:

a partition member for selectively, and at least partially, obstructing said wellbore passageway; and a plug member, composed at least partially of a force-compacted, and at least partially drained, particulate matter, for laterally transferring a selected amount of force from said source of axial force to said wellbore surface.

2. The load-bearing and sealing apparatus according to claim 1 wherein said particulate matter comprises at least one type of particulate material.

3. The load-bearing and sealing apparatus according to claim 1 wherein said particulate matter comprises:

a mixture including at least:

(a) a first component having particles of a first selected average dimension; and (b) a second component having particles of a second selected average dimension.

4. The load-bearing and sealing apparatus according to claim 1 wherein said particulate matter comprises a selected mixture of a plurality of components of particulate material, each component defining a different and discrete average particle dimension, with said different and discrete average particle dimensions varying across a selected range of values.

5. The load-bearing and sealing apparatus according to claim 1, which is operable in a plurality of modes of operation, including:

a delivery mode of operation during which said particulate matter is conveyed into said wellbore to a position adjacent said partition member;

a compact mode of operation during which axial force from a fluid column is applied to said particulate matter to compact said particulate matter, to drain fluid from at least a portion of said particulate matter, and to form said plug member with at least one substantially fluid-impermeable region; and a force-transfer mode of operation during which said plug member transfers force from said source of axial force away from said partition member and to said wellbore surface.

6. The load-bearing and sealing apparatus according to claim 5, which is further operable in:

a positioning mode of operation during which said partition member is delivered to a desired location within said wellbore.

7. The load-bearing and sealing apparatus according to claim 5, which is further operable in:

a wash-out mode of operation during which said plug member is disintegrated by application of a high pressure fluid stream; and a communication mode of operation, with said plug member disintegrated and said partition member removed from said central passageway, during which communication is allowed between said first wellbore region and said second wellbore region.

8. The load-bearing and sealing apparatus according to claim 1, wherein said particulate matter includes at least one binder component which fills interstitial spaces between other components of said particulate matter.

9. The load-bearing and sealing apparatus according to claim 8, wherein said binder component enhances fluid impermeability of said plug member.

10. The load-bearing and sealing apparatus according to claim 8, wherein said binder component permits said particulate matter to generally continuously deform and reform into said plug member without failure of said plug member and enhances transfer of axial force to said wellbore surface.

11. A load-bearing apparatus for use in a wellbore subject to a axial force from source of axial force, with fluid being disposed in at least a portion of said wellbore, said wellbore having a wellbore surface defined therein which at least partially defines a passageway which allows communication of fluids and objects between a first wellbore region and a second wellbore region, comprising:

a partition member for selectively, and at least partially, obstructing said passageway;

a plug member, composed at least partially of a fluid-force-compacted particulate matter, for laterally transferring force from said source of axial force to said wellbore surface; and a drain member for removing said fluid from at least a portion of said plug member, at least during compaction, to allow compaction.

12. The load-bearing apparatus according to claim 11, wherein said drain member directs said fluid through said partition member.

13. The load-bearing apparatus according to claim 11, wherein said drain member is integral with said partition member.

14. The load-bearing apparatus according to claim 11, wherein said drain member removes said fluid from a region of said plug member which is adjacent said partition member.

15. The load-bearing apparatus according to claim 11, wherein said partition member comprises an inflatable packing element and said drain member defines a fluid flow path through said inflatable packing element.

16. The load-bearing apparatus according to claim 11, which is operable in a plurality of modes of operation, including:

a delivery mode of operation during which said particulate matter is conveyed into said wellbore in a fluid slurry form to a position adjacent said partition member;

a compaction mode of operation during which axial force from a fluid-column is applied to said particulate matter to compact said particulate matter and thus at least partially cause formation of said plug member;

a drainage mode of operation during which fluid is removed from at least a portion of said plug member; and a force-transfer mode of operation during which said plug member transfers force from said source of axial force away from said partition member and to said wellbore surface.

17. The load-bearing apparatus according to claim 16, further operable in:

a positioning mode of operation during which said partition member is delivered to a selected position relative to said wellbore surface.

18. A load-bearing apparatus according to claim 16, further operable in:

a wash-out mode of operation during which said plug member is disintegrated by application of a high pressure fluid stream; and a communication mode of operation, with said plug member disintegrated and said partition member removed from said passageway, during which communication of said fluids and said objects is allowed between said first wellbore region and said second wellbore region.

19. The load-bearing apparatus according to claim 11, wherein said particulate matter includes at least one binder component which fills interstitial spaces between other components of said particulate matter.

20. The load-bearing apparatus according to claim 19, wherein said binder component enhances fluid impermeability of said plug member.

21. The load-bearing apparatus according to claim 19, wherein said binder component permits said particulate matter to generally continuously deform and reform into said plug member without failure of said plug member.

22. The load-bearing apparatus according to claim 19, wherein said binder component includes at least a colloidal hydrating material.

23. The load-bearing apparatus according to claim 19, wherein said binder component includes at least bentonite.

24. A load-bearing and sealing apparatus for use in a wellbore subject to axial force, said wellbore having a wellbore conduit therein which has a central passageway defined therethrough which allows communication of fluids and objects between a first wellbore region and a second wellbore region, comprising:

a partition member for selectively, and at least partially, obstructing said central passageway of said wellbore conduit between said first wellbore region and said second wellbore region, which engages said wellbore conduit and which can withstand axial force less than a failure threshold amount;

a plug member, composed at least partially of a particulate matter, which has been mechanically compacted by said axial force and at least partially drained during compaction, and a binder component for filling interstitial spaces in said particulate matter, said plug member being disposed between a source of said axial force and said partition member, and in contact with said wellbore conduit;

wherein said plug member transfers to said wellbore conduit a portion of said axial force in an amount at least as much as said axial force exceeds said failure threshold amount, and thus protecting said removable partition member from receipt of excessive axial force amounts; and wherein said plug member defines a relatively substantially fluid-impermeable barrier to minimize flow between said first wellbore region and said second wellbore region.

25. The load-bearing and sealing apparatus according to claim 24, wherein a force-transference capacity of said plug member is at least partially dependent upon a cross-sectional area of said wellbore conduit and a length of said plug member.

26. The load-bearing and sealing apparatus according to claim 24, wherein a force-transference capacity of said plug member is at least partially dependent upon composition of said particulate matter.

27. The load-bearing and sealing apparatus according to claim 26, wherein said force-transference capacity of said plug member is at least partially dependent upon relative apportionment according to average dimension of components of said particulate matter.

28. A load-bearing and sealing apparatus for use in a wellbore, said wellbore having a wellbore conduit therein which has a central passageway defined therethrough which allows communication of fluids and objects between a first wellbore region and a second wellbore region, said wellbore being coupled to a source of high pressure fluid, comprising:

a partition member for selectively, and at least partially, obstructing said central passageway of said wellbore conduit between said first wellbore region and said second wellbore region, which engages said wellbore conduit and which can withstand axial force less than a failure threshold amount;

a plug member, composed at least partially of (a) a particulate matter which has been mechanically compacted between a fluid column provided by said source of high pressure fluid and said removable partition member and (b) a binder component for filling interstitial spaces in said particulate matter, said plug member being disposed between said source of high pressure fluid and said removable partition member, and in contact with said wellbore conduit;

which is operable in a plurality of operating modes, including:

(a) a plug member formation mode of operation wherein said removable partition member is delivered to a selected location within said central passageway of said wellbore conduit and urged into engagement with said wellbore conduit, and said particulate matter and said binder component are delivered to a selected position within said wellbore conduit adjacent said partition member and compacted by said fluid column provided by said source of high pressure fluid to form said plug member;

(b) a force-transference and sealing mode of operation, wherein (1) at least said axial force in excess of said failure threshold is transferred laterally through said plug member to said wellbore conduit to minimize axial force applied to said partition member and (2) at least a portion of said particulate matter defines a relatively fluid-permeable barrier; and (c) an optional plug disintegration mode of operation, wherein said plug member is disintegrated by application of a high pressure fluid stream thereto.

29. The load-bearing and sealing apparatus according to claim 28, wherein, during said plug member formation mode of operation, said particulate matter and said binder component are delivered to said selected position in slurry form.

30. The load-bearing and sealing apparatus according to claim 28, wherein, during said plug member formation mode of operation, fluid is drained from at least a portion of said plug member.

31. The load-bearing and sealing apparatus according to claim 28, further operable in a:

positioning mode of operation, wherein said partition member is delivered to a selected location within said wellbore conduit.

32. The load-bearing and sealing apparatus according to claim 28, wherein during said plug member formation mode of operation, compression of said particulate matter and said binder component causes said binder component to fill interstitial spaces between particles of said particulate matter.

33. The load-bearing and sealing apparatus according to claim 28, wherein, during said plug member formation mode of operation, compression of said particulate matter and said binder component results in development of regions in said plug member of differing fluid permeabilities.

34. The load-bearing and sealing apparatus according to claim 33, wherein, during said plug formation mode of operation, compression of said particulate matter and said binder component causes formation of said plug member with at least one region defining a relatively substantially fluid-impermeable region which is in contact with wellbore fluids.

35. The load-bearing and sealing apparatus according to claim 28, wherein, during said optional plug disintegration mode of operation, said particulate matter and said binder component are removed from said wellbore conduit in slurry form.

36. A pressure plug for use in a wellbore to transfer force away from a wellbore tool disposed in the wellbore to the wellbore itself, the pressure plug comprising:

a mass of particulate matter formed adjacent said wellbore tool, said mass of particulate matter including:

(a) at least one class of individual particulate matter that is insoluble in water, each of said at least one class of individual particulate material having an average particle dimension different from that of any other class of the individual particulate material; and (b) a binder material.

37. The pressure plug according to claim 36, wherein said at least one individual particulate material is silicon dioxide.

38. The pressure plug according to claim 36, wherein said binder material is colloid material.

39. The pressure plug according to claim 38, wherein said colloid material is bentonite.

40. A method of forming a pressure plug in a wellbore, comprising the method steps of:

providing a plurality of types of particulate material, including at least:

(a) a coarse granular material that is insoluble in water;

(b) an intermediate granular material that is insoluble in water;

(c) a fine granular material that is insoluble in water; and (d) a colloid material;

forming a mixture of said plurality of types of particulate material;

depositing said mixture of said plurality of types of particulate material adjacent a selected wellbore structure;

compacting said plurality of types of particulate material into a plug by applying a high force fluid column thereto; and draining fluid from at least a portion of said plug during at least compaction.

41. An aggregate mixture for use in forming a pressure plug in a wellbore, the aggregate mixture comprising:

a plurality types of particulate materials that are insoluble in water, each type of the particulate materials having a particulate size range which is different from that of the other types of particulate materials; and a hydrating ultra-fine material.

42. A method of transferring axial force in a wellbore from a fluid column to a wellbore surface, comprising the method steps of:

at least partially obstructing a portion of said wellbore with an obstructing member;

delivering a mass of particulate material to said wellbore in a position adjacent said obstructing member;

applying said axial force from said fluid column to said mass of particulate material causing mechanical compaction of said mass of particulate material and reducing fluid permeability of said mass of particulate material; and transferring through said mass of particulate material a selected amount of axial force to said wellbore surface.

43. A method of transferring axial force according to claim 42, further comprising:

reversibly binding said mass of particulate material together with a binding component.

44. A method of transferring axial force according to claim 43, further comprising:

filling interstitial spaces in said mass of particulate material with said binding component.

45. A method of transferring axial force according to claim 42, further comprising:

filling interstitial spaces in said mass of particulate material with a hydrating component.

46. A method of transferring axial force according to claim 42, further comprising:

removing said mass of particulate material from said wellbore by applying a high pressure fluid stream thereto.

47. A method of transferring axial force according to claim 42, further comprising:

disintegrating said mass of particulate material by applying a removal fluid thereto; and removing said mass of particulate material, in slurry form, from said wellbore.

48. The method of transferring axial force according to claim 42, further comprising:

removing fluid from said mass of particulate material during compaction.

49. A method of transferring stress from a wellbore tool disposed in a wellbore to the wellbore itself, the method comprising the steps of:

delivering an aggregate mixture into said wellbore wherein said aggregate mixture is deposited proximally to said wellbore tool;

applying force to said aggregate mixture; and removing fluid from said aggregate mixture to form a substantially solid, substantially fluid-impermeable plug of said aggregate mixture, wherein force loads on said wellbore tool are transferred by said substantially solid substantially fluid-impermeable plug to said wellbore and away from said wellbore tool.

50. A load-bearing and sealing apparatus for use in a wellbore subject to a source of axial force, said wellbore having a wellbore surface defined therein which forms at least a part of a wellbore passageway which allows communication of fluids and objects between a first wellbore region and a second wellbore region, comprising:

a partition member for selectively, and at least partially, obstructing said wellbore passageway; and a plug member, composed at least partially of (a) a force-compacted, and at least partially drained, particulate matter, for laterally transferring a selected amount of axial force from said source of axial force to said wellbore surface, and (b) at least one layer of drainage material disposed adjacent said particulate matter.

51. The load-bearing and sealing apparatus according to claim 50 wherein said particulate matter comprises a selected mixture of a plurality of components of particulate material, each component defining a different and discrete average particle dimension, with said different and discrete average particle dimensions varying across a selected range of values.

52. The load-bearing and sealing apparatus according to claim 50, wherein said particulate matter includes at least one binder component which fills interstitial spaces between other components of said particulate matter.

53. The load-bearing and sealing apparatus according to claim 52, wherein said binder component enhances fluid impermeability of said plug member.

54. The load-bearing and sealing apparatus according to claim 52, wherein said binder component permits said particulate matter to generally continuously deform and reform into said plug member without failure of said plug member and enhances transfer of axial force to said wellbore surface.

55. The load-bearing and searching apparatus according to claim 50, further including:

a drain member for removing fluid from said particulate matter and said at least one layer of drainage material.

56. The load-bearing apparatus according to claim 55, wherein said drain member directs said fluid through said partition member.

57. The load-bearing apparatus according to claim 55, wherein said drain member is integral with said partition member.

58. The load-bearing apparatus according to claim 55, wherein said drain member removes said fluid from a region of said plug member which is adjacent said partition member.

59. The load-bearing apparatus according to claim 55, wherein said partition member comprises an inflatable packing element and said drain member defines a fluid flow path through said inflatable packing element.

60. A load-bearing and sealing apparatus of claim 50, which is operable in a plurality of operating modes, including:

(a) a plug member formation mode of operation wherein said partition member is delivered to a selected location within said central passageway of said wellbore conduit and urged into engagement with said wellbore conduit, and said particulate matter and said drainage material are delivered to a selected position within said wellbore conduit adjacent said partition member and compacted by a fluid column provided by a source of high pressure fluid to form said plug member; and (b) a force-transference and sealing mode of operation, wherein (1) at least said axial force in excess of a failure threshold is transferred laterally through said plug member to said wellbore conduit to minimize axial force applied to said partition member and (2) at least a portion of said particulate matter defines a relatively fluid-permeable barrier.

61. A load-bearing and sealing apparatus for use in a wellbore subject to a source of axial force, said wellbore having a wellbore surface defined therein which forms at least a part of a wellbore passageway which allows communication of fluids and objects between a first wellbore region and a second wellbore region, comprising:

a partition member for selectively engaging and sealing against said wellbore surface, and being able to withstand safely a differential pressure up to a particular limiting differential pressure; and a plug member, composed at least partially of a force-compacted, and at least partially drained, particulate matter, for laterally transferring a selected amount of force from said source of axial force to said wellbore surface, enabling said partition member to operate safely when exposed to differential pressures which exceed said particular limiting differential pressure.

62. The load-bearing and sealing apparatus according to claim 1 wherein said particulate matter comprises a selected mixture of a plurality of components of particulate material, each component defining a different and discrete average particle dimension, with said different and discrete average particle dimensions varying across a selected range of values.

63. A load-bearing and sealing apparatus according to claim 62, wherein said particulate matter includes a sufficient proportion of relatively large particulate material to allow disintegration of said plug member when exposed to a fluid jet.

64. A load-bearing and sealing apparatus according to claim 61, wherein said particulate matter includes a hydrating material which bonds to water.

65. A load-bearing and sealing apparatus according to claim 61, wherein gross water, which is not bonded to said particulate matter, is substantially removed from at least a portion of said plug member.

66. A load-bearing and sealing apparatus according to claim 61, wherein said particulate matter includes at least one drainage region for receiving fluid which is expelled from other regions of said plug member.

67. A load-bearing and sealing apparatus according to claim 61, wherein said partition member includes a drain member for cooperating in removal of fluid from at least a portion of said plug member.

68. A load-bearing and sealing apparatus according to claim 61, wherein said partition member comprises (a) an inflatable sealing element, and (b) a drain mechanism for removing fluid from at least a portion of said plug member.

69. A load-bearing and sealing apparatus according to claim 68, wherein said inflatable sealing member is adapted for passage through a production tubing string in said wellbore.

70. A load-bearing and sealing apparatus according to claim 68, wherein said plug member enables utilization of said partition member in a broad range of diameters for said wellbore surface.

71. A load-bearing apparatus for use in a wellbore comprising:

a wellbore tool for at least partially obstructing a wellbore passageway; and a plug member, composed at least partially of a force-compacted, and at least partially drained, particulate matter, for anchoring said wellbore tool relative to said wellbore passageway.

72. The load-bearing apparatus according to claim 71 wherein said particulate matter comprises at least one type of particulate material.

73. The load-bearing apparatus according to claim 71 wherein said particulate matter comprises:

a mixture including at least:

(a) a first component having particles of a first selected average dimension; and (b) a second component having particles of a second selected average dimension.

74. The load-bearing apparatus according to claim 71 wherein said particulate matter comprises a selected mixture of a plurality of components of particulate material, each component defining a different and discrete average particle dimension, with said different and discrete average particle dimensions varying across a selected range of values.

75. The load-bearing apparatus according to claim 71, which is operable in a plurality of modes of operation, including:

a delivery mode of operation during which said particulate matter is conveyed into said wellbore to a position adjacent said partition member;

a compaction mode of operation during which axial force is applied to said particulate matter to compact said particulate matter, to drain fluid from at least a portion of said particulate matter, and to form said plug member; and a force-transfer mode of operation during which said plug member transfers force from said source of axial force away from said partition member and to said wellbore surface and thereby anchoring said wellbore tool.

76. The load-bearing apparatus according to claim 75, which is further operable in:

a positioning mode of operation during which said partition member is delivered to a desired location within said wellbore.

77. The load-bearing apparatus according to claim 75, which is further operable in:

a wash-out mode of operation during which said plug member is disintegrated by application of a high pressure stream; and a communication mode of operation, with said plug member disintegrated and said partition member removed from said central passageway and unanchoring said wellbore tool, during which communication is allowed between said first wellbore region and said second wellbore region.

78. The load-bearing and sealing apparatus according to claim 71, wherein said particulate matter includes at least one binder component which fills interstitial spaces between other components of said particulate matter.

79. The load-bearing and sealing apparatus according to claim 78, wherein said binder component enhances fluid impermeability of said plug member.

80. The load-bearing and sealing apparatus according to claim 78, wherein said binder component permits said particulate matter to generally continuously deform and reform into said plug member without failure of said plug member and enhances anchoring of said wellbore tool.

81. A load-bearing and sealing apparatus for use in a wellbore subject to axial force, said wellbore having a wellbore surface therein which at least partially defines a central passageway which allows communication of fluids and objects between a first wellbore region and a second wellbore region, comprising:

a partition member for selectively, and at least partially, obstructing said central passageway between said first wellbore region and said second wellbore region, which engages said wellbore surface and which can withstand axial force less than a failure threshold amount;

a plug member, composed at least partially of a particulate matter, which has been mechanically compacted by said axial force and which is disposed between a source of said axial force and said partition member, and in contact with said wellbore surface;

wherein said plug member transfers to said wellbore surface a portion of said axial force in an amount at least as much as said axial force exceeds said failure threshold amount, and thus protecting said removable partition member from receipt of excessive axial force amounts; and wherein said plug member defines a relatively substantially fluid-impermeable barrier to minimize flow between said first wellbore region and said second wellbore region.

82. The load-bearing and sealing apparatus according to claim 81, wherein a force-transference capacity of said plug member is at least partially dependent upon a cross-sectional area of said wellbore conduit and a length of said plug member.

83. The load-bearing and sealing apparatus according to claim 81, wherein a force-transference capacity of said plug member is at least partially dependent upon composition of said particulate matter.

84. The load-bearing and sealing apparatus according to claim 83, wherein said force-transference capacity of said plug member is at least partially dependent upon relative apportionment according to dimension of components of said particulate matter.

85. A load-bearing and sealing apparatus for use in a wellbore, said wellbore having a wellbore surface therein which at least partially defines a passageway which allows communication of fluids and objects between a first wellbore region and a second wellbore region, said wellbore being coupled to a source of high pressure fluid, comprising:

a partition member for selectively, and at least partially, obstructing said passageway between said first wellbore region and said second wellbore region, which engages said wellbore surface and which can withstand axial force less than a failure threshold amount;

a plug member, composed at least partially of (a) a particulate matter which has been mechanically compacted between a fluid column provided by said source of high pressure fluid and said removable partition member and (b) a binder component for filling interstitial spaces in said particulate matter, said plug member being disposed between said source of high pressure fluid and said removable partition member, and in contact with said wellbore surface;

which is operable in a plurality of operating modes, including:

(a) a plug member formation mode of operation wherein said removable partition member is delivered to a selected location within said central passageway of said wellbore conduit and urged into engagement with said wellbore surface, and said particulate matter and said binder component are delivered to a selected position within said wellbore adjacent said partition member and compacted by said fluid column provided by said source of high pressure fluid to form said plug member;

(b) a force-transference and sealing mode of operation, wherein (1) at least said axial force in excess of said failure threshold is transferred laterally through said plug member to said wellbore surface to minimize axial force applied to said partition member and (2) at least a portion of said particulate matter defines a relatively fluid-permeable barrier; and (c) an optional plug disintegration mode of operation, wherein said plug member is disintegrated by application of a high pressure stream thereto.

86. The load-bearing and sealing apparatus according to claim 85, wherein, during said plug member formation mode of operation, said particulate matter and said binder component are delivered to said selected position in slurry form.

87. The load-bearing and sealing apparatus according to claim 85, wherein, during said plug member formation mode of operation, fluid is drained from at least a portion of said plug member.

88. The load-bearing and sealing apparatus according to claim 85, further operable in a:

positioning mode of operation, wherein said partition member is delivered to a selected location within said wellbore conduit.

89. The load-bearing and sealing apparatus according to claim 85, wherein during said plug member formation mode of operation, compression of said particulate matter and said binder component causes said binder component to fill interstitial spaces between particles of said particulate matter.

90. The load-bearing and sealing apparatus according to claim 85, wherein, during said plug member formation mode of operation, compression of said particulate matter and said binder component results in development of regions in said plug member of differing fluid permeabilities.

91. The load-bearing and sealing apparatus according to claim 90, wherein, during said plug formation mode of operation, compression of said particulate matter and said binder component causes formation of said plug member with at least one region defining a relatively substantially fluid-impermeable region which is in contact with wellbore fluids.

92. The load-bearing and sealing apparatus according to claim 85, wherein, during said optional plug disintegration mode of operation, said particulate matter and said binder component are removed from said wellbore conduit in slurry form.

93. A load-bearing apparatus for use in a wellbore subject to a axial force from source of axial force, with fluid being disposed in at least a portion of said wellbore, said wellbore having a wellbore surface defined therein which at least partially defines a passageway which allows communication of fluids and objects between a first wellbore region and a second wellbore region, comprising:

a partition member for selectively, and at least partially, obstructing said passageway;

a plug member, composed at least partially of a fluid-force-compacted particulate matter, for laterally transferring force from said source of axial force to said wellbore surface; and a drain path defined relative to said partition member for removing said fluid from at least a portion of said plug member, at least during compaction, to allow compaction.

94. The load-bearing apparatus according to claim 81, wherein said drain path directs said fluid through said partition member.

95. The load-bearing apparatus according to claim 93, wherein said drain path is integral with said partition member.

96. The load-bearing apparatus according to claim 93, wherein said drain path removes said fluid from a region of said plug member which is adjacent said partition member.

97. The load-bearing apparatus according to claim 93, wherein said partition member comprises an inflatable packing element and said drain member defines a fluid flow path through said inflatable packing element.

98. A pressure plug for use in a wellbore to transfer force away from a wellbore tool disposed in the wellbore to the wellbore itself, the pressure plug comprising:

a mass of particulate matter formed adjacent said wellbore tool, said mass of particulate matter including:

(a) at least one class of individual particulate matter that is insoluble in water, each of said at least one class of individual particulate material having a particle dimension range different from that of any other class of the individual particulate material; and (b) a binder material.

99. A method of forming a pressure plug in a wellbore, comprising the method steps of:

providing particulate material, including at least one of:

(a) a coarse granular material that is insoluble in water;

(b) an intermediate granular material that is insoluble in water;

(c) a fine granular material that is insoluble in water; and providing a binder material;

forming a mixture of said particulate material and said binder material;

depositing said mixture of said particulate material and said binder material adjacent a selected wellbore structure;

compacting said of particulate material into a plug by applying a high force fluid column thereto; and draining fluid from at least a portion of said plug during at least compaction.

* * * * *